US009713837B2

(12) United States Patent
Zhu et al.

(10) Patent No.: US 9,713,837 B2
(45) Date of Patent: Jul. 25, 2017

(54) WATER SPOT COOLING DEVICE OF BOTTOM MOLD FOR WHEEL HUB CASTING AND METHOD FOR COOLING BOTTOM MOLD

(71) Applicant: CITIC Dicastal CO., LTD, Qinhuangdao (CN)

(72) Inventors: Lin Zhu, Qinhuangdao (CN); Changhai Li, Qinhuangdao (CN); Hongbiao Li, Qinhuangdao (CN); Peng Zhou, Qinhuangdao (CN); Yongning Wang, Qinhuangdao (CN); Zhihua Zhu, Qinhuangdao (CN); Binyu Xiong, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 26 days.

(21) Appl. No.: 14/980,848

(22) Filed: Dec. 28, 2015

(65) Prior Publication Data

US 2016/0207098 A1 Jul. 21, 2016

(30) Foreign Application Priority Data

Dec. 25, 2014 (CN) ..... 2014 1 0825990

(51) Int. Cl.
*B22C 9/06* (2006.01)
*B22D 18/04* (2006.01)

(52) U.S. Cl.
CPC ..... *B22C 9/065* (2013.01); *B22D 18/04* (2013.01)

(58) Field of Classification Search
CPC ..... B22C 9/065; B22C 9/28; B22D 18/04
See application file for complete search history.

(56) References Cited

U.S. PATENT DOCUMENTS 8,047,262 B2 * 11/2011 Kweon ..... B22D 18/04 164/284

FOREIGN PATENT DOCUMENTS

CN 102398013 A * 4/2012

* cited by examiner

*Primary Examiner* — Kevin E Yoon
(74) *Attorney, Agent, or Firm* — Maier & Maier, PLLC

(57) ABSTRACT

The present invention provides a water spot cooling device of a bottom mold for wheel hub casting, a method for cooling a bottom mold by using the device, and a method for manufacturing the device. The device and the method of the present invention have the advantages that multi-path spot cooling required by spoke cooling is integrated into one device; the influence of backwater on the mold is eliminated and stable production is benefited; the effluent water from the multi-path spot cooling is gathered to one backwater opening through a backwater crossing and a backwater annular passage, thereby simplifying a backwater device and making the pipeline connection of the device simpler; and there is no special part in the whole device so that the machining cost is reduced and the maintenance is more convenient.

8 Claims, 6 Drawing Sheets

WATER SPOT COOLING DEVICE OF BOTTOM MOLD FOR WHEEL HUB CASTING AND METHOD FOR COOLING BOTTOM MOLD

TECHNICAL FIELD

The present invention relates to the field of casting, in particular to a water spot cooling device of a bottom mold for wheel hub casting and a preparation method.

BACKGROUND

In the field of low-pressure casting of aluminum wheels, a water cooling mold has become a development direction for future mold development, while water spot cooling will be the key point of the future development direction. Facing various changes of wheel structures, water spot cooling shall not only be applied to side mold cooling, but also be applied to bottom mold cooling. Especially for large-size wheel types, only depending on side mold cooling, it is difficult to ensure the quality of spokes. Therefore, it will be imperative to develop a device capable of achieving water spot cooling of a bottom mold. Moreover, the developed device can never be limited by product structures, and must be suitable for all kinds of products so as to ensure the popularization and the application of water spot cooling in bottom mold cooling.

SUMMARY OF THE PRESENT INVENTION

Therefore, the purpose of the present invention is to provide a device capable of achieving water spot cooling of a bottom mold. The device can achieve water spot cooling of the bottom mold and is not limited by the product structures.

The present invention provides the following technical solution to achieve the above-mentioned purpose of the present invention:

In one aspect of the present invention, a water spot cooling device of a bottom mold for wheel hub casting is provided, characterized in that the device comprises: (1) an annular spot cooling upper cover plate 1 which comprises a clearance boss 3, a through hole 9 located in the clearance boss 3, and a through hole 11 used for bolt fastening; (2) an annular spot cooling lower supporting plate 2, which is assembled with the annular spot cooling upper cover plate 1 and comprises a backwater crossing 5, a backwater annular passage 6 in fluid communication with the backwater crossing 5, a backwater opening 7 in fluid communication with the backwater annular passage 6, an irregular-shaped through hole 10 in fluid communication with the backwater crossing 5, and a stepped through hole 12 used for bolt fastening; (3) a water pipe 14 in fluid communication with the irregular-shaped through hole 10; (4) a backwater pipe 8 in fluid communication with the backwater annular passage 6; and (5) a water inlet branch pipe 13, which is sleeved on the linear through hole portion of the irregular-shaped through hole, penetrates through the through hole 9 and is in fluid communication with the water pipe 14; moreover, the irregular-shaped through hole 10 consists of a semi-cylindrical through hole portion and a linear through hole portion perpendicular to the curved surface of the semi-cylindrical through hole portion; and the spot cooling upper cover plate 1 and the spot cooling lower supporting plate 2 are assembled by aligning the through hole 11 with the through hole 12 through the welding and the fastening of a gasket 16 and a screw 17, and in the assembled state, the through hole 9 and the backwater crossing 5 are in fluid communication. Preferably, the irregular-shaped through hole 10 and the through hole 9 are aligned.

According to one preferred aspect of the present invention, the lower part of the spot cooling lower supporting plate 2 also comprises a semicircular groove 4 used for installing the water pipe 14, and the water pipe 14 is installed on the semicircular groove 4 and fixed by welding on the spot cooling lower supporting plate 2. Preferably, the diameter of the semicircular groove 4 is equal to the outside diameter of the water pipe 14.

According to one preferred aspect of the present invention, the height of the clearance boss 3 is 1 to 2 mm and the diameter is greater than the diameter of the through hole 9. Preferably, the diameter of the clearance boss 3 is 20 to 24 mm.

According to one preferred aspect of the present invention, the inside diameter of the water pipe 14 is greater than or equal to four times the inside diameter of the water inlet branch pipe 13, and the inside diameter of a water inlet manifold 15 is less than or equal to the inside diameter of the water pipe 14. Preferably, the inside diameter of the water pipe 14 is four to eight times the inside diameter of the water inlet branch pipe 13, and the inside diameter of the water inlet manifold 15 is 0.3 to 1 time the inside diameter of the water pipe 14.

According to one preferred aspect of the present invention, the widths of the backwater crossing 5 and the backwater annular passage 6 are greater than the diameter of the through hole 9, and the depths are not less than one third of the height of the through hole 9. The inside diameter of the backwater pipe 8 is equal to the diameter of the backwater opening 7.

According to one preferred aspect of the present invention, the diameter of the backwater opening 7 is equal to the width of the backwater annular passage 6.

According to another aspect of the present invention, a method for cooling a bottom mold for wheel hub casting is provided. The method comprises the steps of: (1) drilling a blind hole in a corresponding position of the bottom mold for wheel hub casting in accordance with the positions of the water inlet branch pipe 13 and the through hole 9 on the spot cooling upper cover plate 1 in the preceding device and the position of the screw 17; (2) connecting the annular spot cooling upper cover plate 1 and the annular spot cooling lower supporting plate 2 in the preceding device by welding into a whole and then fixing the same to the bottom mold for wheel hub casting through the screw 17; and (3) delivering water with a pressure of 4 to 6 atm and a water temperature of 25° C. to 30° C. into the water inlet manifold 15.

According to another aspect of the present invention, a method for manufacturing the preceding device is provided, characterized in that the method comprises the steps of: (1) processing the clearance boss 3, the through hole 9 positioned in the clearance boss 3 and the through hole 11 used for bolt fastening on the annular spot cooling upper cover plate 1; (2) processing the backwater crossing 5, the backwater annular passage 6 in fluid communication with the backwater crossing 5, the backwater opening 7 in fluid communication with the backwater annular passage 6, the irregular-shaped through hole 10 in fluid communication with the backwater crossing 5, and the stepped through hole 12 used for bolt fastening on the annular spot cooling lower supporting plate 2; (3) aligning the annular spot cooling upper cover plate 1 and the annular spot cooling lower supporting plate 2 through the through hole 11 and the stepped through hole 12 and welding and fastening the same by using the gasket 16 and the screw 17; (4) connecting the water pipe 14, the water inlet manifold 15 and the water inlet branch pipe 13 by welding into a whole, installing the water inlet branch pipe 13 on the semicircular groove 4 through the irregular-shaped through hole 10 and fixing the water inlet branch pipe 13 by welding; and (5) installing the backwater pipe 8 on the backwater opening 7.

In other aspects of the present invention, the following technical solution is also provided:

The technical solution of the present invention is: the water spot cooling device of the bottom mold comprises a spot cooling upper cover plate 1, a spot cooling lower supporting plate 2, a water inlet waterway system, a backwater waterway system and a fastening and sealing system.

The spot cooling upper cover plate 1 is provided with an equal number of clearance bosses 3, through holes 9 and through holes 11 used for bolt fastening corresponding to the spot cooling position of the bottom mold. The height of the clearance bosses 3 is designed to be 1 to 2 mm and the diameter is greater than or equal to the diameter of the through holes 9.

The spot cooling lower supporting plate 2 is provided with a semicircular groove 4 used for installing a water pipe 14, a backwater crossing 5, a backwater annular passage 6, a backwater opening 7, an irregular-shaped through hole 10 and a stepped through hole 12 used for bolt fastening. The diameter of the semicircular groove 4 is required to be equal to the outside diameter of the water pipe 14.

The water inlet waterway system consists of a water inlet branch pipe 13, the water pipe 14 and a water inlet manifold 15. The inside diameter of the water pipe 14 is required to be greater than or equal to four times the inside diameter of the water inlet branch pipe 13, and the inside diameter of the water inlet manifold 15 is less than or equal to the inside diameter of the water pipe 14.

The backwater waterway system consists of a backwater crossing 5, a backwater annular passage 6, a backwater opening 7 and a backwater pipe 8. The widths of the backwater crossing 5 and the backwater annular passage 6 are required to be greater than the diameter of the through holes 9, and the depths are required to be not less than one third of the height of the through holes 9. The inside diameter of the backwater pipe 8 is equal to the diameter of the backwater opening 7.

The fastening and sealing system is mainly formed by welding a gasket 16 and a screw 17.

The diameter of the linear section portion of the irregular-shaped through hole 10 is slightly greater than the outside diameter of the water inlet branch pipe 13. The diameter of the backwater opening 7 is equal to the width of the backwater annular passage 6.

The water inlet waterway system is installed on the semicircular groove 4 and is fixed by welding on the spot cooling lower supporting plate 2.

In other aspects of the present invention, a preparation method for preparing the preceding water spot cooling device of the bottom mold is also provided, comprising a spot cooling upper cover plate 1, a spot cooling lower supporting plate 2, a water inlet waterway system, a backwater waterway system and a fastening and sealing system.

According to drawing requirements, a qualified spot cooling upper cover plate 1 and a qualified spot cooling lower supporting plate 2 are processed. Through welding, the spot cooling upper cover plate 1 and the spot cooling lower supporting plate 2 are welded into a whole. According to the arrangement requirement of a cooling pipeline, the water inlet waterway system is made. Through welding, the water inlet branch pipe 13, the water pipe 14 and the water inlet manifold 15 are connected into a whole. The backwater pipe 8 is welded in the position of the backwater opening 7 of the spot cooling lower supporting plate 2. The water spot cooling device of the bottom mold is installed on the bottom mold. The water spot cooling device of the bottom mold achieves high integration, not only integrates multi-path spot cooling into the device, but also integrates backwater of each path of spot cooling into one backwater opening, and thoroughly eliminates the constraint of the product structures on spot cooling implementation. Moreover, the device is simple in installation, convenient in maintenance and favorable for popularization and implementation.

In other aspects of the present invention, the following technical solution is also provided:

1. A water spot cooling device of a bottom mold, comprising a spot cooling upper cover plate 1, a spot cooling lower supporting plate 2, a water inlet waterway system and a backwater waterway system, and characterized in that: the water inlet waterway system consists of a water inlet branch pipe 13, a water pipe 14 and a water inlet manifold 15; and the backwater waterway system consists of a backwater crossing 5, a backwater annular passage 6, a backwater opening 7 and a backwater pipe 8.

2. The water spot cooling device of the bottom mold according to previous paragraph 1, characterized in that: a clearance boss 3 is designed on the spot cooling upper cover plate 1; the height of the boss is controlled to be 1 to 2 mm; and the diameter is greater than or equal to the diameter of a through hole 9.

3. The water spot cooling device of the bottom mold according to previous paragraph 1, characterized in that: a semicircular groove 4, a backwater crossing 5, a backwater annular passage 6 and a backwater opening 7 are designed on the spot cooling lower supporting plate 2; and the diameter of the semicircular groove 4 is required to be equal to the outside diameter of the water pipe 14.

4. The water spot cooling device of the bottom mold according to previous paragraph 1, characterized in that: the water inlet waterway system consists of a water inlet branch pipe 13, a water pipe 14 and a water inlet manifold 15; the inside diameter of the water pipe 14 is required to be greater than or equal to four times the inside diameter of the water inlet branch pipe 13; and the inside diameter of the water inlet manifold 15 is less than or equal to the inside diameter of the water pipe 14.

5. The water spot cooling device of the bottom mold according to previous paragraph 1, characterized in that: the backwater waterway system consists of a backwater crossing 5, a backwater annular passage 6, a backwater opening 7 and a backwater pipe 8; the widths of the backwater crossing 5 and the backwater annular passage 6 are required to be greater than the diameter of the through hole 9; the depths are required to be not less than one third of the height of the through hole 9; and the inside diameter of the backwater pipe 8 is equal to the diameter of the backwater opening 7.

The water spot cooling device of the bottom mold of the present invention is not limited to the content of the present invention and the contents of specific embodiments. Other design manners obtained according to the enlightenment of the content of the present invention shall fall into the protection scope of the present invention.

In a specific aspect of the present invention, the following specific processing technological parameters are provided:

Material of the annular spot cooling upper cover plate: ductile iron;

Thickness of the annular spot cooling upper cover plate 1: 15 to 25 mm;

Diameter of the clearance boss 3: 20 to 24 mm;

Height of the clearance boss 3: 1 to 2 mm;

Diameter of through hole 9: 12 to 20 mm;

Diameter of through hole 11: 13 to 14 mm;

Material of the annular spot cooling lower supporting plate 2: ductile iron;

Thickness of the annular spot cooling lower supporting plate 2: 25 to 45 mm;

Depth of the backwater crossing 5: 5 to 10 mm;

Width of the backwater crossing 5: 16 to 24 mm;

Depth of the backwater annular passage 6: 5 to 15 mm;

Width of the backwater annular passage 6: 16 to 20 mm;

Diameter of the backwater opening 7: 8 to 14 mm;

Shape of the irregular-shaped through hole 10: an upper hole with an inverted shape of Chinese character Ba is connected with a straight hole which is connected with a lower hole with a shape of Chinese character Ba;

Processing parameters of the stepped through hole 12: the diameter of a large hole is 20 mm and the diameter of a small hole is 13 to 14 mm;

Parameters of the water pipe 14: the inside diameter is 14 to 20 mm and the outside diameter is 16 to 22 mm;

Diameter of the backwater pipe 8: the inside diameter is 8 to 14 mm and the outside diameter is 10 to 16 mm;

Inside diameter of the water inlet branch pipe 13: 2 to 4 mm; and

Outside diameter of the water inlet branch pipe 13: 4 to 8 mm.

Alternatively, the present invention also provides the following technological parameters:

Material of the annular spot cooling upper cover plate: vermicular cast iron;

Thickness of the annular spot cooling upper cover plate 1: 15 to 25 mm;

Diameter of the clearance boss 3: 20 to 24 mm;

Height of the clearance boss 3: 1 to 2 mm;

Diameter of through hole 9: 12 to 20 mm;

Diameter of through hole 11: 13 to 14 mm;

Material of the annular spot cooling lower supporting plate 2: vermicular cast iron;

Thickness of the annular spot cooling lower supporting plate 2: 25 to 45 mm;

Depth of the backwater crossing 5: 5 to 10 mm;

Width of the backwater crossing 5: 16 to 24 mm;

Depth of the backwater annular passage 6: 5 to 15 mm;

Width of the backwater annular passage 6: 16 to 20 mm;

Diameter of the backwater opening 7: 8 to 14 mm;

Shape of the irregular-shaped through hole 10: an upper hole with an inverted shape of Chinese character Ba is connected with a straight hole which is connected with a lower hole with a shape of Chinese character Ba;

Processing parameters of the stepped through hole 12: the diameter of a large hole is 20 mm and the diameter of a small hole is 13 to 14 mm;

Parameters of the water pipe 14: the inside diameter is 14 to 20 mm and the outside diameter is 16 to 22 mm;

Diameter of the backwater pipe 8: the inside diameter is 8 to 14 mm and the outside diameter is 10 to 16 mm;

Inside diameter of the water inlet branch pipe 13: 2 to 4 mm; and

Outside diameter of the water inlet branch pipe 13: 4 to 8 mm.

The present invention brings the following beneficial technical effects:

(1) Multi-path spot cooling required by spoke cooling is integrated into one device, which is favorable for implementation and popularization; (2) the backwater waterway system is designed on the spot cooling lower supporting plate, thereby eliminating the influence of backwater on the mold and being favorable for stable production; (3) the effluent water from the multi-path spot cooling is gathered to one backwater opening through the backwater crossing and the backwater annular passage, thereby simplifying the backwater device and making the pipeline connection of the device simpler; and (4) there is no special part in the whole device so that the machining cost is reduced and the maintenance is more convenient.

In a preferred aspect of the present invention, the effect of preventing the effluent water from rebounding and entering the spot cooling hole in the mold again is unexpectedly achieved by selecting that the widths of the backwater crossing 5 and the backwater annular passage 6 are greater than the diameter of the through hole 9 and the depths are not less than one third of the height of the through hole 9.

In a preferred aspect of the present invention, the inside diameter of the water pipe 14 is greater than or equal to four times the inside diameter of the water inlet branch pipe 13, and the inside diameter of the water inlet manifold 15 is less than or equal to the inside diameter of the water pipe 14, thereby ensuring that the flow of each water inlet branch pipe is as consistent as possible and ensuring the smooth operation of the device.

In a preferred aspect of the present invention, the backwater back pressure is reduced to ensure smooth backwater by selecting that the diameter of the backwater opening 7 is equal to the width of the backwater annular passage 6.

BRIEF DESCRIPTION OF THE DRAWINGS

The implementation solution of the present invention is described below in detail in conjunction with the accompanying drawings, wherein.

DETAILED DESCRIPTION OF THE EMBODIMENTS

Figure 1:
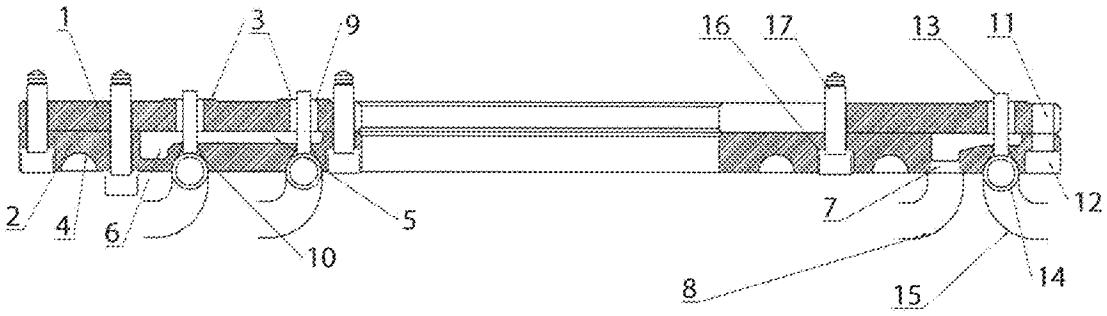
FIG. 1: a longitudinal section diagram of the device of embodiment 1; 1-spot cooling upper cover plate; 2-spot cooling lower supporting plate; 3-clearance boss; 4-semicircular groove; 5-backwater crossing; 6-backwater annular passage; 7-backwater opening; 8-backwater pipe; 9-through hole; 10-irregular-shaped through hole; 11-through hole; 12-stepped through hole; 13-water inlet branch pipe; 14-water pipe; 15-water inlet manifold; 16-gasket; and 17-screw.
Figure 2:
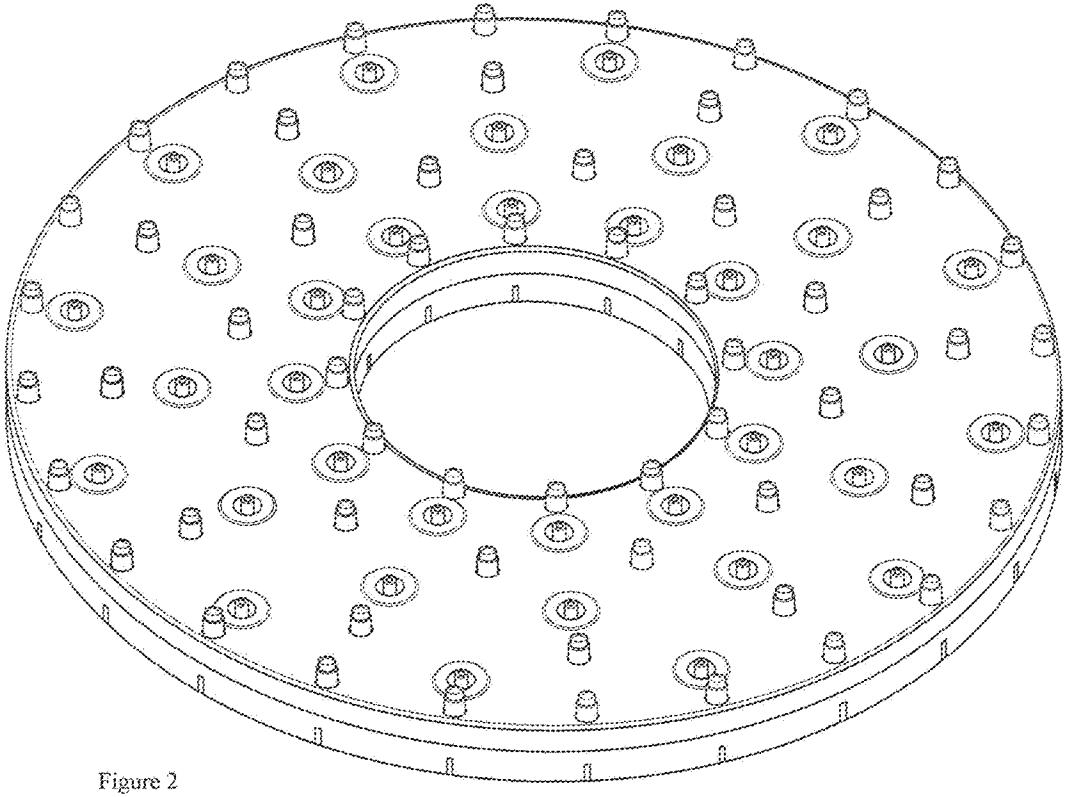
FIG. 2: a top perspective view of the device of embodiment 1.
Figure 3:
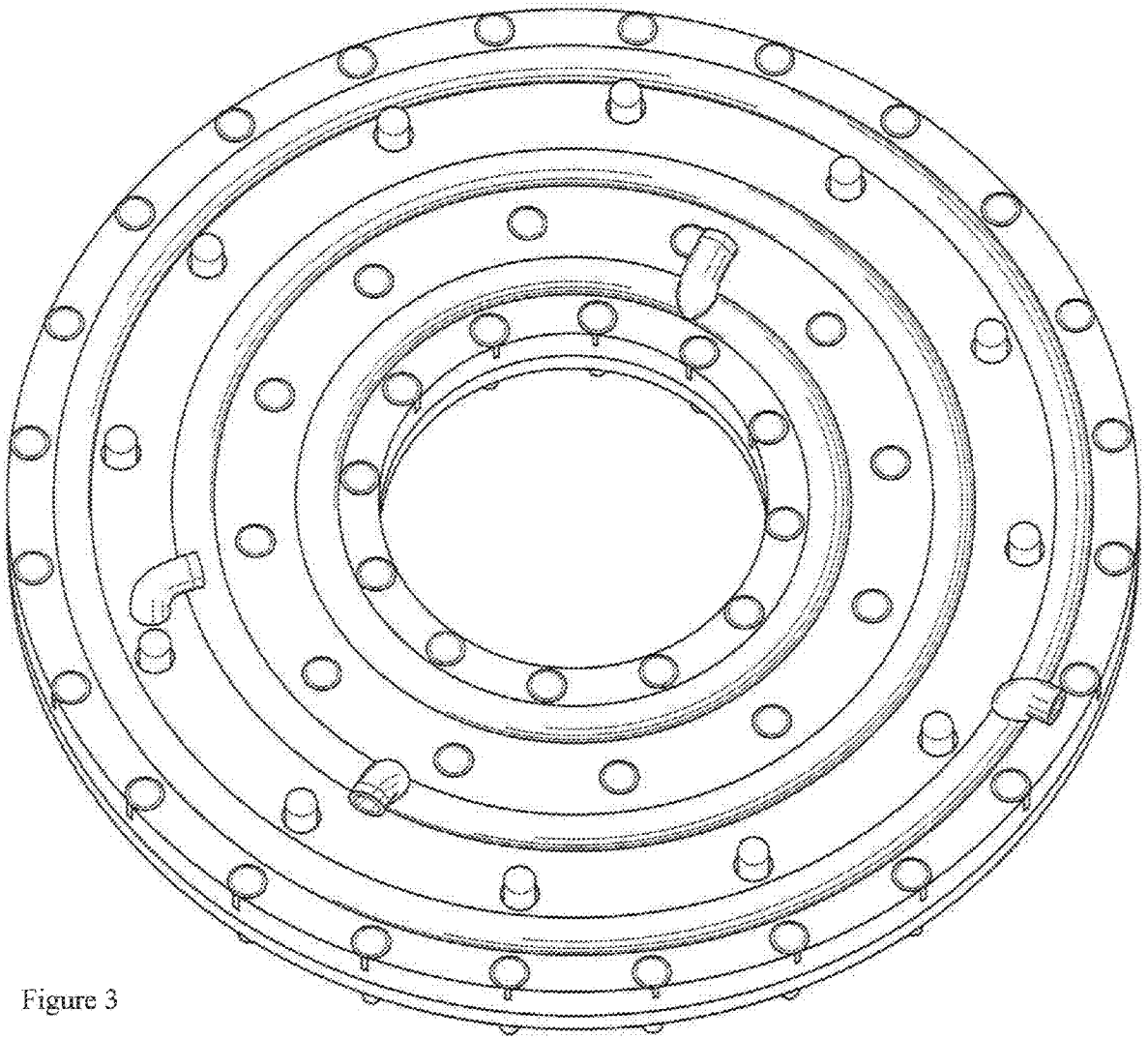
FIG. 3: a bottom perspective view of the device of embodiment 1.
Figure 4:
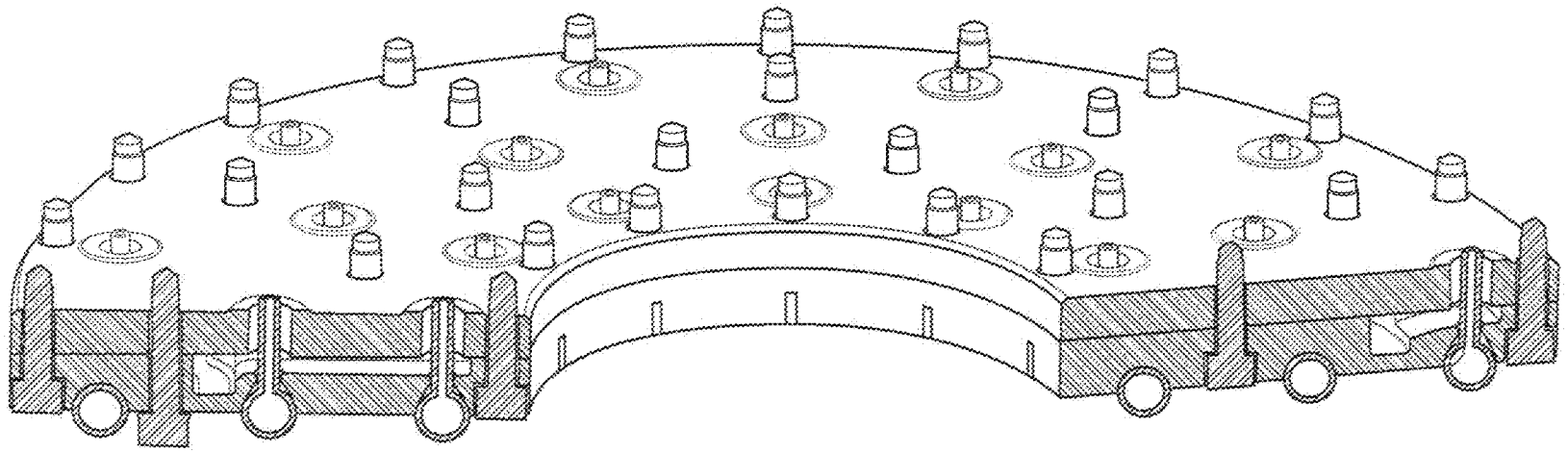
FIG. 4: a perspective cross-section view of the device of embodiment 1.
Figure 5A:
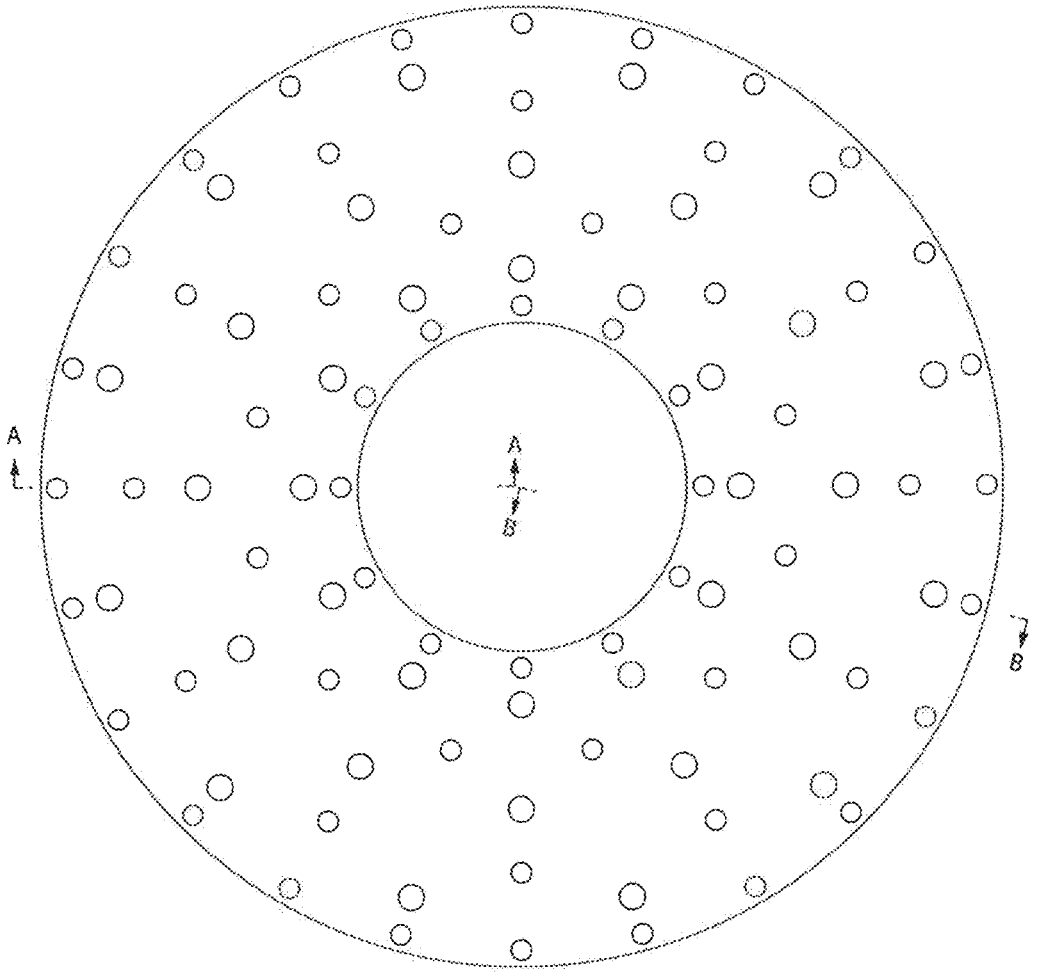
FIG. 5A: an interior plan view of the spot cooling upper cover plate.
Figure 5B:
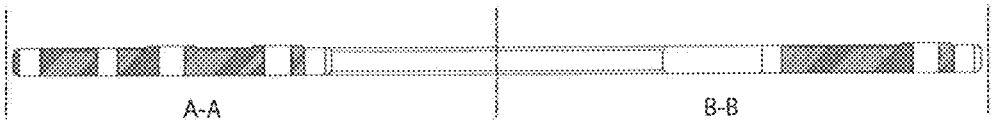
FIG. 5B: a cross-section elevation view of the spot cooling upper cover plate.
Figure 6A:
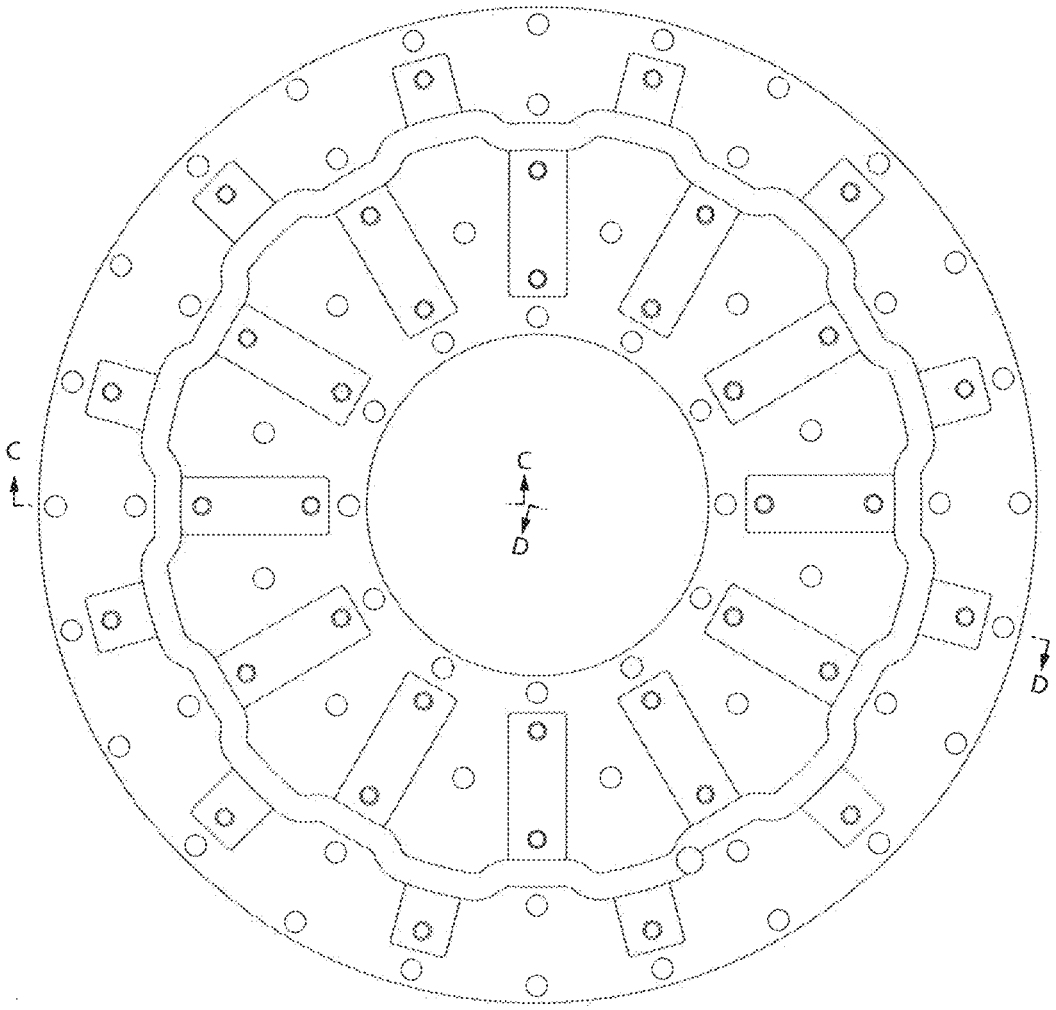
FIG. 6A: an interior plan view of the device of the spot cooling lower supporting plate.
Figure 6B:
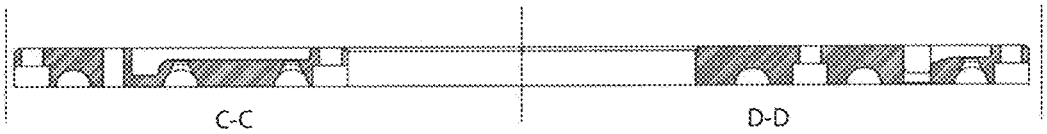
FIG. 6B: a cross-section elevation view of the spot cooling lower supporting plate.

Now referring to FIGS. 1-6B generally, a water spot cooling device of a bottom mold for wheel hub casting and a method for cooling a bottom mold may be provided.

Embodiment 1 Manufacture of the Water Spot Cooling Device of the Bottom Mold The water spot cooling device of the bottom mold is processed in accordance with the following technological parameters:

TABLE 1

Technological Parameters for Processing Water Spot cooling Device of Bottom Mold

| Item | Group 1 | Group 2 | Group 3 | Group 4 |
|---|---|---|---|---|
| Material of annular spot cooling upper cover plate | Ductile iron | Ductile iron | Vermicular cast iron | Vermicular cast iron |
| Thickness of annular spot cooling upper cover plate 1/mm | 15 | 25 | 15 | 25 |
| Diameter of clearance boss 3/mm | 20 | 24 | 20 | 24 |
| Height of clearance boss 3/mm | 1 | 2 | 1 | 2 |
| Diameter of through hole 9/mm | 12 | 20 | 12 | 20 |
| Diameter of through hole 11/mm | 13 | 14 | 13 | 14 |
| Material of annular spot cooling lower supporting plate 2 | Ductile iron | Ductile iron | Vermicular cast iron | Vermicular cast iron |
| Thickness of annular spot cooling lower supporting plate 2/mm | 25 | 45 | 25 | 45 |
| Depth of backwater crossing 5/mm | 5 | 10 | 5 | 10 |
| Width of backwater crossing 5/mm | 16 | 24 | 16 | 24 |
| Depth of backwater annular passage 6/mm | 5 | 15 | 5 | 15 |
| Width of backwater annular passage 6/mm | 16 | 20 | 16 | 20 |
| Diameter of backwater opening 7/mm | 8 | 14 | 8 | 14 |
| Shape of irregular-shaped through hole 10 | An upper hole with an inverted shape of Chinese character Ba is connected with a straight hole which is connected with a lower hole with a shape of Chinese character Ba | An upper hole with an inverted shape of Chinese character Ba is connected with a straight hole which is connected with a lower hole with a shape of Chinese character Ba | An upper hole with an inverted shape of Chinese character Ba is connected with a straight hole which is connected with a lower hole with a shape of Chinese character Ba | An upper hole with an inverted shape of Chinese character Ba is connected with a straight hole which is connected with a lower hole with a shape of Chinese character Ba |
| Large hole diameter of stepped through hole 12/mm | 20 | 20 | 20 | 20 |
| Small hole diameter of stepped through hole 12/mm | 13 | 14 | 13 | 14 |
| Inside diameter of water pipe 14/mm | 14 | 20 | 14 | 20 |
| Outside diameter of water pipe 14/mm | 16 | 22 | 16 | 22 |
| Inside diameter of backwater pipe 8/mm | 8 | 14 | 8 | 14 |

TABLE 1-continued

| Technological Parameters for Processing Water Spot cooling Device of Bottom Mold | | | | |
|---|---|---|---|---|
| Item | Group 1 | Group 2 | Group 3 | Group 4 |
| Outside diameter of backwater pipe 8/mm | 10 | 16 | 10 | 16 |
| Inside diameter of water inlet branch pipe 13/mm | 2 | 4 | 2 | 4 |
| Outside diameter of water inlet branch pipe 13/mm | 4 | 8 | 4 | 8 |

The processing method is as follows:

(1) processing the clearance boss 3, the through hole 9 positioned in the clearance boss 3 and the through hole 11 used for bolt fastening on the annular spot cooling upper cover plate 1; (2) processing the backwater crossing 5, the backwater annular passage 6 in fluid communication with the backwater crossing 5, the backwater opening 7 in fluid communication with the backwater annular passage 6, the irregular-shaped through hole 10 in fluid communication with the backwater crossing 5, and the stepped through hole 12 used for bolt fastening on the annular spot cooling lower supporting plate 2; (3) aligning the annular spot cooling upper cover plate 1 and the annular spot cooling lower supporting plate 2 through the through hole 11 and the stepped through hole 12 and welding and fastening the same by using the gasket 16 and the screw 17; (4) installing the water pipe 14 on the irregular-shaped through hole 10; (5) installing the backwater pipe 8 on the backwater annular passage 6; and (6) making the water inlet branch pipe penetrate through the through hole 9 and sleeving the water inlet branch pipe on the linear portion of the irregular-shaped through hole.

Embodiment 2: Cooling Effect Test of the Water Spot Cooling Device of the Bottom Mold of Embodiment 1

Firstly, the water spot cooling device groups 1-4 of the bottom mold of embodiment 1 are installed on the bottom mold for casting aluminum alloy wheel hubs (19X8J, 12 spokes), and the method is as follows:

(1) drilling a blind hole in a corresponding position of the bottom mold for wheel hub casting in accordance with the positions of the water inlet branch pipe 13 and the through hole 9 on the spot cooling upper cover plate 1 in the preceding device and the position of the screw 17; and (2) fixing the preceding device to the bottom mold for wheel hub casting through the screw.

Thermocouples are arranged at the root of the spokes of the bottom mold and in the position of an outer ring of a flange, and water with a pressure of 4 to 6 atm and a water temperature of 25° C. to 30° C. is delivered into the water inlet manifold 15; and the temperature change in the position where the bottom mold is arranged is measured.

Specifically, each group of test is carried out by adopting the conditions shown in Table 2:

TABLE 2

| Cooling Test Parameters of Spot cooling Device of Embodiment 1 | | | |
|---|---|---|---|
| Group Number | Spot cooling Device | Water Pressure/atm | Water Temperature/° C. |
| 1 | Group 1 of spot cooling device | 4 | 25 |
| 2 | Group 1 of spot cooling device | 6 | 30 |
| 3 | Group 2 of spot cooling device | 4 | 30 |
| 4 | Group 2 of spot cooling device | 6 | 25 |
| 5 | Group 3 of spot cooling device | 4 | 25 |
| 6 | Group 3 of spot cooling device | 6 | 30 |
| 7 | Group 4 of spot cooling device | 4 | 30 |
| 8 | Group 4 of spot cooling device | 6 | 25 |

It is found that in all groups of tests, the temperature at the root of the spokes is about 400° C. and the temperature at the outer ring of the flange is about 500° C. It indicates that the temperature gradient among the spokes is effectively enhanced, and there is no overhigh temperature at the outer ring of the flange, thereby better ensuring the product appearance.

Embodiment 3: Pilot Scale Test of the Water Spot Cooling Device of the Bottom Mold of Embodiment 1

The used bottom mold for casting aluminum alloy wheel hubs has the following specifications:

3-1 Test group. The used bottom mold for casting wheel hubs has the specification: 19X8J, 12 spokes. According to the method of embodiment 2, group 1 of water spot cooling device of the bottom mold of embodiment 1 is installed on the bottom mold (1) for casting aluminum alloy wheel hubs, and water with a pressure of 4 atm and a water temperature of 25° C. is delivered into the water inlet manifold 15.

3-2 Contrast group. The used bottom mold for casting wheel hubs has the specification: 19X8J, 12 spokes. The water spot cooling device of the bottom mold of embodiment 1 is not installed.

Under a stable technological condition, the time of continuous production is 2 days.

No. (1) mold: The production quantity of wheel hubs is 620, wherein the porosity is 0.2%; and No. (2) mold: The production quantity of wheel hubs is 480, wherein the porosity is 1.1%.

It can be seen that under the condition of using the water spot cooling device of the bottom mold of the present invention, the porosity is reduced by 0.9%. Meanwhile, because the water spot cooling method is used for cooling the bottom mold, the production interval time is shortened so that the production efficiency is increased by 29.17%.

In a low-pressure casting production line in which an annual yield is 3 million wheel hubs, the economic benefit attributable only to a decrease in porosity, an increase in rate of good products, an increase in production efficiency and energy conservation is nearly ten million yuan.

At present, the device and the method are used by CITIC Dicastal Wheel Manufacturing Co., Ltd. for pilot scale production within the company, and a favorable application prospect is obtained. If the device and the method are applied to a wheel hub production platform of CITIC Dicastal with an annual yield of thirty million wheel hubs, enormous economic and social benefits will be brought.

The invention claimed is:

1. A water spot cooling device of a bottom mold for wheel hub casting, comprising:

an annular spot cooling upper cover plate which comprises a clearance boss, a through hole located in the clearance boss, and a through hole used for bolt fastening;

an annular spot cooling lower supporting plate, which is assembled with the annular spot cooling upper cover plate and comprises a backwater crossing, a backwater annular passage in fluid communication with the backwater crossing, a backwater opening in fluid communication with the backwater annular passage, an irregular-shaped through hole in fluid communication with the backwater crossing, and a stepped through hole used for bolt fastening;

a water pipe in fluid communication with the irregular-shaped through hole;

a backwater pipe in fluid communication with the backwater annular passage; and a water inlet branch pipe, which is sleeved on a linear through hole portion of the irregular-shaped through hole, penetrates through the through hole and is in fluid communication with the water pipe; and the irregular-shaped through hole has semi-cylindrical through hole portion and the linear through hole portion perpendicular to the curved surface of the semi-cylindrical through hole portion; the spot cooling upper cover plate and the spot cooling lower supporting plate are assembled by aligning the through hole with the stepped through hole through welding and fastening of a gasket and a screw, and in the assembled state, the through hole and the backwater crossing are in fluid communication; and the irregular-shaped through hole and the through hole are aligned.

2. The device of claim 1, wherein the lower part of the spot cooling lower supporting plate also comprises a semicircular groove used for installing the water pipe, and the water pipe is installed on the semicircular groove and fixed by welding on the spot cooling lower supporting plate; and the diameter of the semicircular groove is equal to the outside diameter of the water pipe.

3. The device of claim 1, wherein the height of the clearance boss is 1 to 2 mm and the diameter is greater than the diameter of the through hole; and the diameter of the clearance boss is 20 to 24 mm.

4. The device of claim 1, wherein the inside diameter of the water pipe is greater than or equal to four times the inside diameter of the water inlet branch pipe, and the inside diameter of a water inlet manifold is less than or equal to the inside diameter of the water pipe; and the inside diameter of the water pipe is four to eight times the inside diameter of the water inlet branch pipe, and the inside diameter of the water inlet manifold is 0.3 to 1 time the inside diameter of the water pipe.

5. The device of claim 1, wherein the widths of the backwater crossing and the backwater annular passage are greater than the diameter of the through hole, and the depths are not less than one third of the height of the through hole; and the inside diameter of the backwater pipe is equal to the diameter of the backwater opening.

6. The device of claim 1, wherein the diameter of the backwater opening is equal to the width of the backwater annular passage.

7. A method for cooling a bottom mold for wheel hub casting, comprising:

drilling a blind hole in a corresponding position of the bottom mold for wheel hub casting in accordance with the positions of the water inlet branch pipe and the through hole on the spot cooling upper cover plate in the device of claim 1 and the position of the screw;

fixing the device of claim 1 to the bottom mold for wheel hub casting through the screw; and delivering water with a pressure of 4 to 6 atm and a water temperature of 25° C. to 30° C. into a water inlet manifold.

8. A method for manufacturing the device of claim 1, comprising the steps of:

processing the clearance boss, the through hole positioned in the clearance boss and the through hole used for bolt fastening on the annular spot cooling upper cover plate;

processing the backwater crossing, the backwater annular passage in fluid communication with the backwater crossing, the backwater opening in fluid communication with the backwater annular passage, the irregular-shaped through hole in fluid communication with the backwater crossing, and the stepped through hole used for bolt fastening on the annular spot cooling lower supporting plate;

aligning the annular spot cooling upper cover plate and the annular spot cooling lower supporting plate through the through hole and the stepped through hole and welding and fastening the same by using the gasket and the screw;

connecting the water pipe, a water inlet manifold and the water inlet branch pipe by welding into a whole, installing the water inlet branch pipe on the semicircular groove through the irregular-shaped through hole and fixing the water inlet branch pipe by welding; and installing the backwater pipe on the backwater opening.

* * * * *